United States Patent [19]

Nishikawa et al.

[11] 4,410,139

[45] Oct. 18, 1983

[54] LIQUID NEBULIZER

[75] Inventors: Kyoichi Nishikawa, Tokyo; Sadao Mitsui, Chiba, both of Japan

[73] Assignee: TDK Electronics Co., Ltd., Tokyo, Japan

[21] Appl. No.: 904,034

[22] Filed: May 8, 1978

[30] Foreign Application Priority Data

May 10, 1977 [JP] Japan ..... 52-59142[U]

[51] Int. Cl.[3] ..... B05B 17/06

[52] U.S. Cl. ..... 239/102; 261/1; 261/DIG. 48

[58] Field of Search ..... 261/1, 81, DIG. 48; 128/193, 194, DIG. 2; 239/102, 123, 124, 338

[56] References Cited

U.S. PATENT DOCUMENTS 3,584,792 6/1971 Johnson ..... 239/338 X 3,901,443 8/1975 Mitsui et al. ..... 239/102

*Primary Examiner*—Andres Kashnikow

*Attorney, Agent, or Firm*—Robert Scobey

[57] ABSTRACT

A liquid nebulizer comprising a nebulizing container for a liquid, an outlet duct, and a transducer at the bottom of the container. A partition surrounding the liquid projection produced by the transducer is included, having its upper edge above the liquid surface, so that large spray particles or drops from the outlet duct fall outside the partition.

7 Claims, 10 Drawing Figures

LIQUID NEBULIZER

BACKGROUND AND BRIEF DESCRIPTION OF THE INVENTION

This invention relates to a liquid nebulizer, and more particularly to a nebulizer for nebulizing liquid fuel by employing ultrasonic waves.

In the past, nebulizers employing ultrasonic waves have been widely used for spraying liquid fuels such as light oil. A typical structure of such nebulizers is shown in U.S. Pat. No. 3,901,443 issued Aug. 26, 1975. As disclosed in that patent, a liquid container is provided with an outlet duct and an air blower. An ultrasonic transducer is fitted on the bottom of the container and has a predetermined inclination with respect to the surface of the liquid to be nebulized. When ultrasonic waves are radiated into the liquid by operating the transducer, a liquid projection is produced on the liquid surface, and a fog composed of minute liquid particles is formed from the top and circumference of the liquid projection. The fog is exhausted through the outlet duct together with the air flow supplied by the air blower. The transducer is inclined with respect to the liquid surface so that the liquid projection is also inclined; in this way large liquid particles from the top of the liquid projection do not fall back on the top of the liquid projection. As a result, nebulizing efficiency is known to be increased by more than several ten percent compared with nebulizers having transducers fitted horizontally, i.e., with no inclination.

When nebulizers employing ultrasonic waves are used in light oil combustion equipment, a very constant quantity of nebulizing is required in order to maintain proper combustion. In the known structure described above, however, although large liquid fuel particles from the liquid projection do not fall on the top of the liquid projection directly, they fall on the liquid surface directly or from the outlet duct as drops, and cause waves on the liquid surface. As a result, a stable liquid projection cannot be formed, and the quantity of nebulizing spray is varied. Furthermore, since liquid fuel such as light oil is heated more by ultrasonic energy than is water and has poor heat conductivity, the temperature difference is increased between the base of the liquid projection where ultrasonic energy is concentrated and the part where ultrasonic energy is weak. Thus a non-uniform temperature distribution between the transducer and the liquid surface occurs when drops of heated liquid fuel fall from the liquid projection and ultrasonic waves radiated from the transducer are reflected and refracted, lose directivity, and do not focus on the liquid surface, resulting in variation of nebulizing quantities and action.

An object of the present invention is to provide a liquid nebulizer producing a stable quantity of nebulizing fog by preventing the rise of waves on the liquid surface where the liquid projection is formed and by supplying thermally uniform liquid to the part of the liquid where ultrasonic waves are transmitted. This object is achieved by utilizing a partition that surrounds the liquid projection, confining particles from the liquid projection and drops from the outlet duct outside the region of the liquid projection.

The embodiments of the present invention are described as follows:

DETAILED DESCRIPTION

Figure 1:
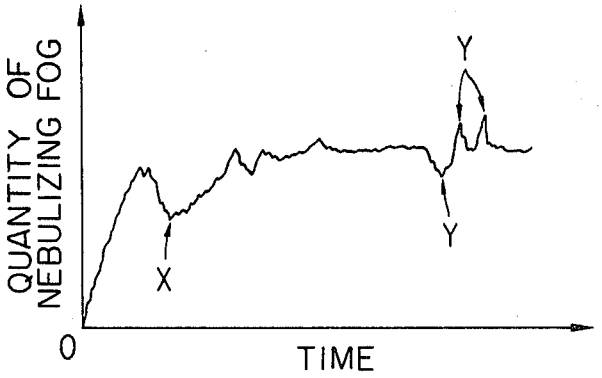
FIG. 1 (PRIOR ART)
FIG. 1 is a graph showing the variation of nebulizing fog with time, the encountered in prior art nebulizers.

FIG. 1 shows the change of nebulizing fog quantity with the lapse of time in a conventional nebulizer in the prior art. As shown in FIG. 1, the spray quantity of fog monotonically increases after starting operation, and is considerably decreased at the point X. This change is due to the sudden radiation of ultrasonic waves in the thermally uniform liquid, causing a steep temperature gradient, and also because the heated drops of the liquid fall on the liquid surface near the liquid projection. Also, after reaching a stable state, the spray quantities vary, as shown at the points Y, due to the variation of the liquid surface and the unevenness of temperature in the liquid.

Figure 2:
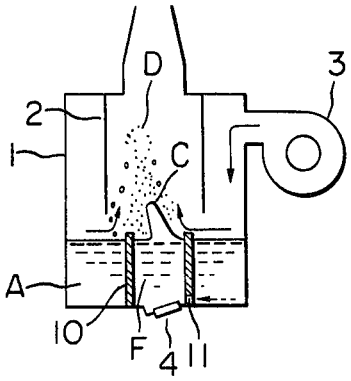
FIG. 2 is a vertical sectional view of a nebulizer embodying the present invention.
Figure 3:
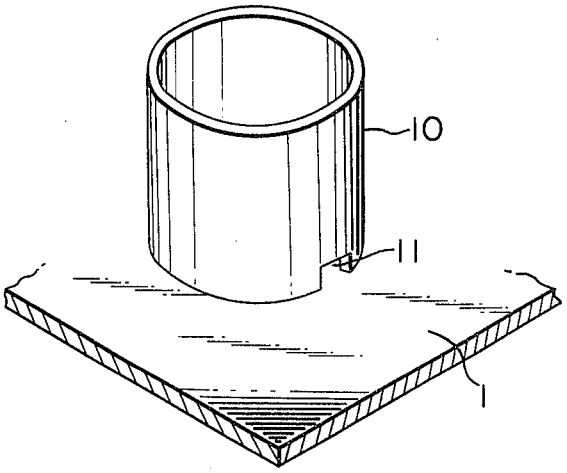
FIG. 3 is a perspective view of a cylinder used as the partition in the nebulizer of FIG. 2.

Referring to FIG. 2, there is illustrated a nebulizer embodying the invention which overcomes the problem of variation of nebulizing action with time just discussed. A cylinder 10 is fitted in nebulizing container 1 as a partition around the part F of liquid A (typically a fuel), and ultrasonic waves are transmitted from transducer 4 into the part F. The cylinder 10 is, as shown in FIG. 3, fitted on the bottom of the container at its lower edge, and the liquid passes through hole 11 at the lower part of the cylinder. The diameter of the cylinder 10 is smaller than that of outlet duct 2. The cylinder is fitted under and within the confines of the outlet duct 2 so that large spray particles liberated from the liquid projection C or drops produced on the inside wall of the outlet duct do not fall in the cylinder 10.

In the nebulizer of FIG. 2, when ultrasonic waves are radiated into liquid A by operating the transducer 4, a liquid projection C is produced on the part F of liquid surface where the ultrasonic waves are transmitted, and the fog D of liquid fuel is formed from the top of and around the liquid projection C. The fog D is exhausted through the outlet duct 2 together with an air flow produced by air blower 3. In this case, heated large particles liberated from the projection C or drops from the outlet duct 2 fall on the liquid surface outside of the cylinder 10 where ultrasonic waves are not transmitted, and are mixed with the liquid in such area making the temperature uniform. Such thermally uniform liquid at the bottom of the container 1 is then led into the cylinder 10 through opening 11.

Figure 4:
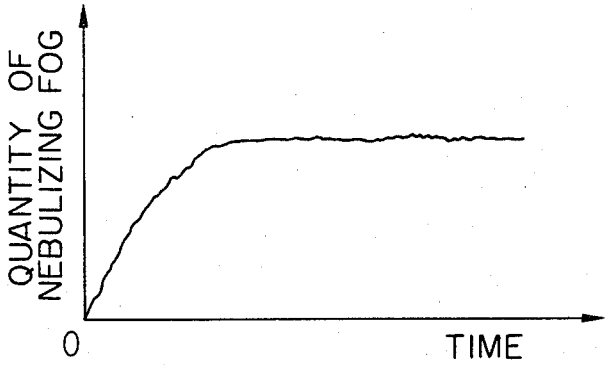
FIG. 4 is a graph showing the relation between time and nebulizing quantity in the nebulizer of FIG. 2.

In the nebulizer of FIG. 2, the rise of waves on the liquid surface and the disturbance of temperature distribution in the liquid caused by the heated liquid particles and the drops from the duct do not affect the inside of the cylinder 10, and a stable liquid projection C is always formed. As a result, nebulizing quantities and action are greatly stabilized. Also, since the temperature gradient in the area F where ultrasonic waves are transmitted is decreased, a decrease of nebulizing food before reaching the normal state, as shown by the symbol X in FIG. 1, is prevented. The action of the nebulizer of FIG. 2 is as shown in FIG. 4, and it is apparent that the amount of nebulizing fog produced monotonically increases with the lapse of time and then is maintained at a normal state.

Figure 5:
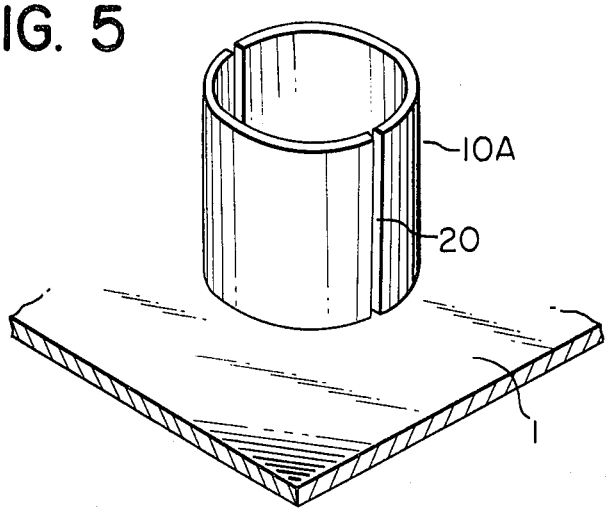
FIG. 5 is a perspective view of a cylinder used as the partition in another embodiment.

FIG. 5 shows a cylinder 10A of another embodiment of the invention. The inside of the cylinder is connected to the outside by means of slits 20. If the width of the slits 20 is narrow enough, then practically the same effect as the cylinder of FIG. 3 is obtained.

Figure 6:
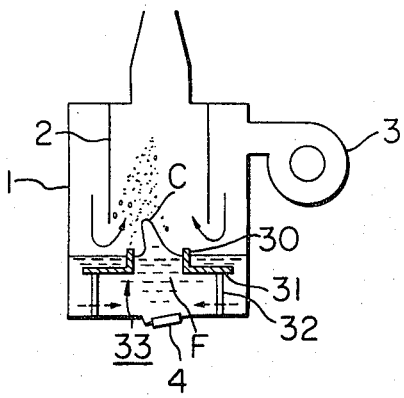
FIG. 6 is a vertical sectional view of another nebulizer embodying the invention.
Figure 7:
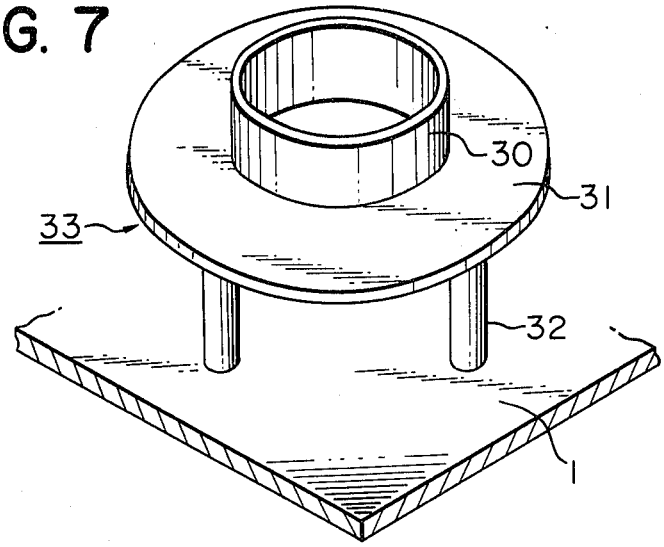
FIGS. 7 and 8 are perspective views of other partitions embodying the invention.

FIG. 6 illustrates another embodiment. The container 1 is provided with a cylinder 30 and a disc 31 shown in FIG. 7 which form a partition 33, which is supported by legs 32 so that the upper edge of the cylinder 30 is projected on the liquid surface. Heated large liquid particles liberated from the projection C or drops from the duct 2 fall on the outside of the cylinder 30 and are led along the upper surface of the disc 31 to the inside wall of the container 1, then to the area F in the cylinder 30 where ultrasonic waves are transmitted. Such heated large particles or drops are, therefore, mixed with the liquid when they pass through such areas, and the liquid temperature is therefore made uniform.

Figure 8:
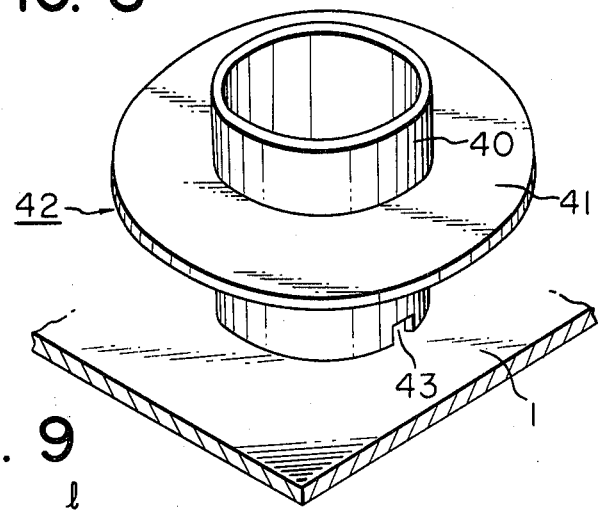

FIG. 8 shows the partition of another embodiment of the invention. A brim or disc 41 is fitted around a cylinder 40, whereby a partition 42 is formed. The partition 42 is fitted on the bottom of the container 1 at the lower edge of the cylinder 40, and a hole 43 is made at the lower part of the cylinder. In such embodiment, a long path for liquid fuel circulation provides the advantage that sufficiently thermally uniform liquid fuel is supplied to the area F in the cylinder 40 where ultrasonic waves are transmitted.

According to the present invention, since the area of the liquid surface where a liquid projection is formed by ultrasonic waves is surrounded by a partition in order to allow heated large particles from the projection or drops from the spray duct to fall on the outside of the partition, the rise of waves on the liquid surface is prevented and a stable projection is formed. Furthermore, since sufficiently thermally uniform liquid is supplied to the area in the partition where ultrasonic waves are transmitted, the quantity of nebulizing fog is not varied by a disturbance or variation of temperature distribution.

Figure 9:
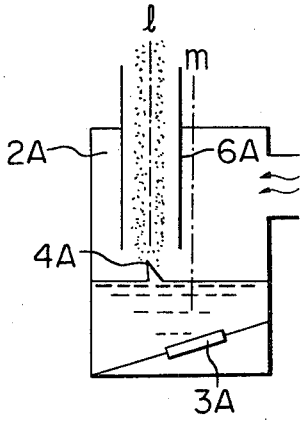
FIG. 9 is a vertical sectional view of another nebulizer construction useful in the practice of the invention, showing the spaced axes relationship of transducer and outlet duct.

Referring now to FIG. 9, a nebulizer is shown in which the cross-sectional area of chamber 2A is relatively small. Spray duct 6A is of a size that can be contained within the chamber 2A, yet is of a cross-sectional area as to ensure the required amount of nebulizing fog. The axis l of the duct 6A and the axis m of ultrasonic transducer 3A can be moved in a plane passing through the center of the vibrating surface of the ultrasonic transducer 3A and vertical to the vibrating surface. The duct 6A and the ultrasonic transducer 3A are fitted so that the top of liquid projection 4A is formed under the center of the duct 6A. It will be noted that the vertical axis m passing through the center of the transducer lies outside the confines of the duct 6A. Such a relationship of duct and transducer may be employed in the nebulizer of FIG. 6, for example, as desired.

Figure 10:
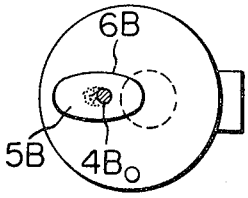
FIG. 10 is a horizontal sectional view of a nebulizer of the type of FIG. 9, showing a different form of outlet duct.

FIG. 10 is a cross-sectional view of another nebulizer configuration as in FIG. 9, wherein the cross-section of spray duct 6B is made oval, and the direction of formation of liquid projection 4B is made to be the same as the long axis of the oval in order to reduce the contact or nebulizing particles 5B on the inside wall of the duct 6B, to increase nebulizing efficiency.

From the description above, it is apparent that modifications can be made in the embodiments of the invention specifically disclosed. The invention should therefore be taken as defined by the following claims.

What is claimed is:

1. In a liquid nebulizer including a nebulizing chamber for containing a liquid to be nebulized, an outlet duct from the chamber, and means for producing a liquid projection on the surface of the liquid within the chamber which generates a fog composed of minute liquid particles that are exhausted from said chamber through said outlet duct, the improvement comprising a partition within said chamber and having an upper edge above said liquid surface and which surrounds said liquid projection and is positioned so that large particles from said liquid projection and drops from said outlet duct fall outside of said partition, and wherein said means for producing said liquid projection comprises a transducer positioned at the bottom of said chamber, a vertical axis passing through the center of said transducer lying outside the confines of said duct.

2. A liquid nebulizer as in claim 1, wherein the cross-section of said duct is an oval shape.

3. In a liquid nebulizer including a nebulizing chamber for containing a liquid to be nebulized, an outlet duct from the chamber, and means for producing a liquid projection on the surface of the liquid within the chamber which generates a fog composed of minute liquid particles that are exhausted from said chamber through said outlet duct, the improvement comprising a partition within said chamber and having an upper edge above said liquid surface and having a lower edge adjacent the bottom of said chamber and which surrounds said liquid projection and is positioned so that large particles from said liquid projection and drops from said outlet duct fall outside of said partition, and wherein said means for producing said liquid projection comprises a transducer positioned at the bottom of said chamber and surrounded by said lower edge of said partition.

4. A liquid nebulizer as in claim 3, wherein said partition has a hole in its bottom part.

5. A liquid nebulizer as in claim 3, wherein said partition has slits in its side wall.

6. A liquid nebulizer as in claim 3 or 4 or 5, in which said partition is spaced from said liquid projection.

7. A liquid nebulizer as in claim 6, in which said partition is not wetted by said liquid projection.

* * * * *